US010663144B2

(12) United States Patent
Jou et al.

(10) Patent No.: US 10,663,144 B2
(45) Date of Patent: May 26, 2020

(54) HUMAN BODY-FRIENDLY LIGHT SOURCE

(71) Applicant: National Tsing Hua University, Hsinchu (TW)

(72) Inventors: Jwo-Huei Jou, Hsinchu (TW); Hsin-Fa Lin, Kaohsiung (TW); Cheng-Chieh Lo, Changhua County (TW)

(73) Assignee: National Tsing Hua University (TW)

( * ) Notice: Subject to any disclaimer, the term of this patent is extended or adjusted under 35 U.S.C. 154(b) by 36 days.

(21) Appl. No.: 16/149,159

(22) Filed: Oct. 2, 2018

(65) Prior Publication Data

US 2019/0368687 A1 Dec. 5, 2019

(30) Foreign Application Priority Data

May 30, 2018 (TW) ..... 107118495 A

(51) Int. Cl.
*F21V 9/08* (2018.01)
*F21V 9/30* (2018.01)

(52) U.S. Cl.
CPC . *F21V 9/08* (2013.01); *F21V 9/30* (2018.02)

(58) Field of Classification Search
None
See application file for complete search history.

(56) References Cited

U.S. PATENT DOCUMENTS

2012/0223661 A1* 9/2012 Bloch ..... H05B 37/0281 315/360
2013/0082589 A1* 4/2013 So ..... H01L 51/5036 313/504
2013/0088860 A1* 4/2013 Edelson ..... F21L 4/02 362/184
2014/0340891 A1* 11/2014 Hyun ..... H05B 33/0803 362/231
2014/0367633 A1* 12/2014 Bibl ..... G02F 1/133603 257/13
2016/0375161 A1* 12/2016 Hawkins ..... H05B 37/02 422/22
2017/0117444 A1* 4/2017 Stoll ..... H01L 51/5281
2017/0142805 A1* 5/2017 Sakaguchi ..... H01L 51/50
2017/0290111 A1* 10/2017 Akiyama ..... H05B 33/0827
2018/0081105 A1* 3/2018 Harada ..... F21V 9/40

* cited by examiner

*Primary Examiner* — Ashok Patel

(57) ABSTRACT

Disclosures of the present invention describe a human body-friendly light source constituted by at least one lighting unit and a plurality of color temperature (CT) reducing films stacked to each other. The CT reducing films are connected to a light emission surface of the lighting unit, so as to apply a color temperature reducing treatment to a light emitted from the lighting unit. Exponential data have proved that, two or more stacked CT reducing films exhibit an apparent color temperature reducing effect on the light. Exponential data have proved that, with the increasing of the stack numbers of the CT reducing films, the light is concerted to an orange-white light with color temperature in a range of 1,000-2,500 K, so as to make a sensitivity of melatonin suppression in response to the light be getting lower.

8 Claims, 13 Drawing Sheets

HUMAN BODY-FRIENDLY LIGHT SOURCE

BACKGROUND OF THE INVENTION

1. Field of the Invention

The present invention relates to the technology field of lighting devices, and more particularly to a human body-friendly light source.

2. Description of the Prior Art

With the development of science technologies, artificial light source is developed from the incandescent bulb invented by Thomas Alva Edison to fluorescent lamp. Furthermore, solid-state lighting devices are recent newly-created artificial light sources, including light-emitting diode (LED), organic light-emitting diode (OLED) and polymer light-emitting diode (PLED).

High-energy visible lights are known including lights with short wavelength such as blue light, indigo light and violet light. RGB color model is an additive color model in which red, green and blue lights are added together in various ways to reproduce a broad array of colors. Name of the model comes from the initials of the three additive primary colors, red, green, and blue. Therefore, it is understood that the blue light must be simultaneously emitted from a display screen of a 3C product (like smart phone or tablet PC) during the operation of video/image displaying of the 3C product. Research report demonstrates that the blue light can penetrate the macular pigment of human eye, so as to cause age-related macular degeneration (AMD) or damage the macular pigment. Research report also indicates that blue light causes more trouble for human eye than other color lights. That is because that it is harder for human eye to focus blue sharply, such that blue light would enable high energy to stress the ciliary muscle of human eye when the eye is exposed to blue light for a long time. As a result, the ciliary muscle tends to getting fatigue or soreness.

It is also found that blue light suppresses melatonin production more than other color lights, and alters circadian rhythms so as to cause human be lack of sleep, leading some diseases to occur such as insomnia and emotional disorder. It is worth mentioning that, both orange-white light having less the lights with short wavelength (like blue light and violet light) and orange-red light having color temperature in a range from 1,500K to 2,000K are now regarded as a human body-friendly light because of making less or minor suppresses melatonin production. Therefore, the orange-white light and/or the orange-red light are suggested to be the most appropriate light source for bedtime reading.

U.S. patent publication No. 2012/008326 A1 discloses a lighting device capable of reducing the phenomenon of melatonin suppression, wherein a light filter is adopted for filtering out the lights with short wavelength (like blue light and purple light) from an emission light provided by a light source. FIG. 1 shows a data plot of color temperature versus luminous efficiency, and FIG. 2 illustrates a CIE chromaticity diagram. Information for the four CIE coordinate points labeled on the CIE chromaticity diagram of FIG. 2 are integrated in following Table (1).

TABLE 1

| No. | CIE coordinate (x, y) | Light classification |
|---|---|---|
| 1 | (0.33, 0.345) | Pure-white light |
| 2 | (0.35, 0.405) | |
| 3 | (0.43, 0.52) | Warm-white |
| 4 | (0.45, 0.545) | Warm-white |

It needs to further explain that, data point with the CIE coordinate of (0.33, 0.345) is measured from an emission light with 6000K color temperature provided by a commercial LED component. On the other hand, after using a first light filter to filter out the lights with wavelength less than 430 nm the emission light provided by the commercial LED component, data point with the CIE coordinate of (0.35, 0.405) is measured from the emission light been treated with the light filtering process. Similarly, after using a second light filter (third light filter) to filter out the lights with wavelength less than 450 nm (470 nm) the emission light provided by the commercial LED component, data point No. 3 (No. 4) is measured from the emission light been treated with the light filtering process.

On the other hand, U.S. Pat. No. 9,803,811 discloses a method for producing high-quality light. According to the disclosures, after the specific CIE coordinate of a color light is adjust to be positioned above and near the Planckian locus (also called black body locus) in the CIE chromaticity diagram, the color light is defined as a high-quality light capable of exhibiting outstanding spectrum resemblance index (SRI) and low Melatonin suppression rate. After making a full consideration on the disclosures of U.S. Pat. No. 9,803,811 and the data of FIG. 2, it is found that, in spite of the fact that the use of light filter is able to reduce color temperature of the emission light provided by the LED component, that also cause CIE coordinate of the emission light be far from the Planckian locus. As a result, the spectrum resemblance index (SRI) of the emission light is also reduced.

From above descriptions, it is understood that the use of light filter can only filter out the lights with short wavelength (like blue light and purple light) from a light, but fails to transform or convert the light to a human body-friendly light. Therefore, it is clear that how to design a human body-friendly lighting device has now became an important issue. Accordingly, the inventors of the present application have made great efforts to make inventive research thereon and eventually provided a human body-friendly light source.

SUMMARY OF THE INVENTION

The primary objective of the present invention is to provide a human body-friendly light source mainly comprising at least one lighting unit and a plurality of color temperature reducing films stacked to each other. The color temperature reducing films are connected to a light emission surface of the lighting unit, so as to apply a color temperature reducing treatment to a light emitted from the lighting unit. Exponential data have proved that, two or more stacked color temperature reducing films exhibit an apparent color temperature reducing effect on the light. Moreover, Exponential data have also proved that, with the increasing of the stack numbers of the color temperature reducing films, the light is eventually concerted to an orange-white light or an orange-red light with color temperature in a range of 1,000-2,500K, so as to make a sensitivity of melatonin suppression in response to the light be getting lower and a maximum permissible exposure time for retina be getting longer.

In order to achieve the primary objective of the present invention, the inventor of the present invention provides one embodiment for the human body-friendly light source, comprising:

at least one lighting unit;

at least one color temperature reducing film, being connected to a light emission surface of the lighting unit, so as to apply a color temperature reducing process to a light outputted from the light emission surface;

wherein when the number of the at least one color temperature reducing film is above two, the color temperature reducing films being stacked to each other;

wherein the light has a color temperature rolling off with the adding of the number of the color temperature reducing films, and also having a CIE coordinate positioning near a Planckian locus in a CIE chromaticity diagram.

In the embodiment of the human body-friendly light source, the light is eventually converted to an orange light, an orange-red light or an orange-white light with the adding of the number of the color temperature reducing films, such that a maximum permissible exposure time for retina is getting longer as well as a sensitivity of melatonin suppression in response to the light is getting lower.

In the embodiment of the human body-friendly light source, the color temperature reducing film is a light conversion film comprising a polymer substrate and a plurality of light conversion particles, wherein the light conversion particles are doped in or enclosed by the polymer substrate.

BRIEF DESCRIPTION OF THE DRAWINGS

The invention as well as a preferred mode of use and advantages thereof will be best understood by referring to the following detailed description of an illustrative embodiment in conjunction with the accompanying drawings, wherein.

DETAILED DESCRIPTION OF THE PREFERRED EMBODIMENTS

To more clearly describe a human body-friendly light source according to the present invention, embodiments of the present invention will be described in detail with reference to the attached drawings hereinafter.

Embodiments of the Human Body-Friendly Light Source

Figure 3:
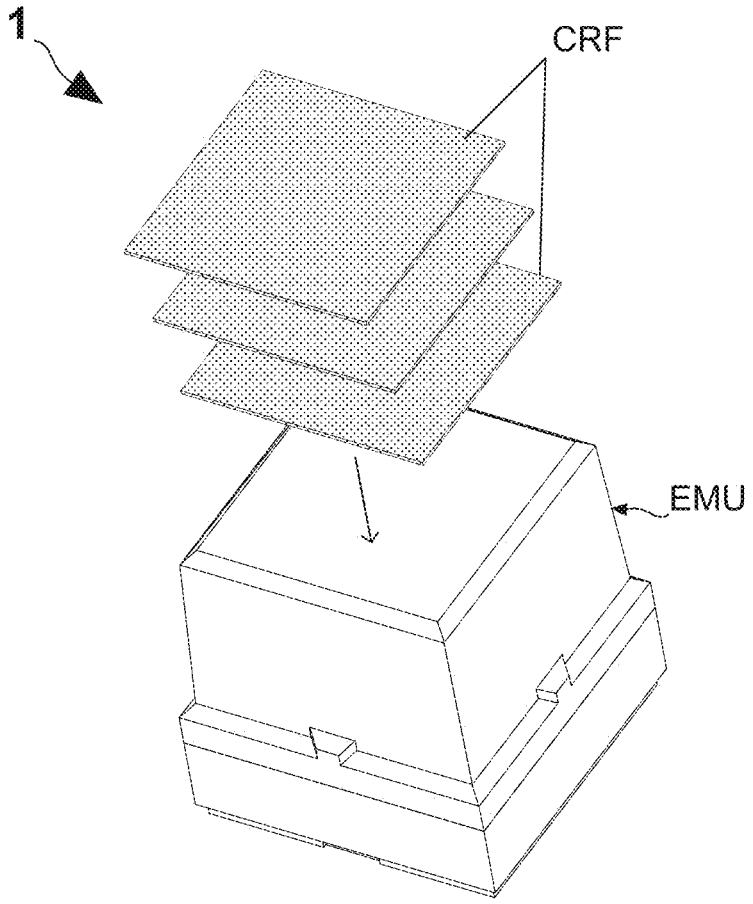
FIG. 3 shows a stereo framework diagram of a human body-friendly light source according to the present invention.

With reference to FIG. 3, there is provided a stereo framework diagram of a human body-friendly light source according to the present invention. As FIG. 3 shows, the human body-friendly light source 1 mainly comprises at least one lighting unit EMU and a color temperature reducing film CRF, wherein the lighting unit EMU can be an LED component, a QD-LED component, an OLED component, a fluorescent lighting device, an LED lighting device, an QD-LED lighting device, an OLED lighting device, a lighting tube, a planar lighting device, or a light bulb. Before starting to clearly describe or introduce the human body-friendly light source 1 of the present invention, it needs to explain the classification of orange light, pure-white, and cold-white light. Please refer to following Table (2), a specific light provided by a specific lighting device must has a corresponding light classification.

TABLE 2

| Color temperature | Light classification |
|---|---|
| <2,500 K | Orange-white light or Orange-red light |
| 2,500-5,500 K | Warm-white light |
| 5,500-6,500 K | Pure-white light |
| >6,500 K | Cold-white light |

Figure 4:
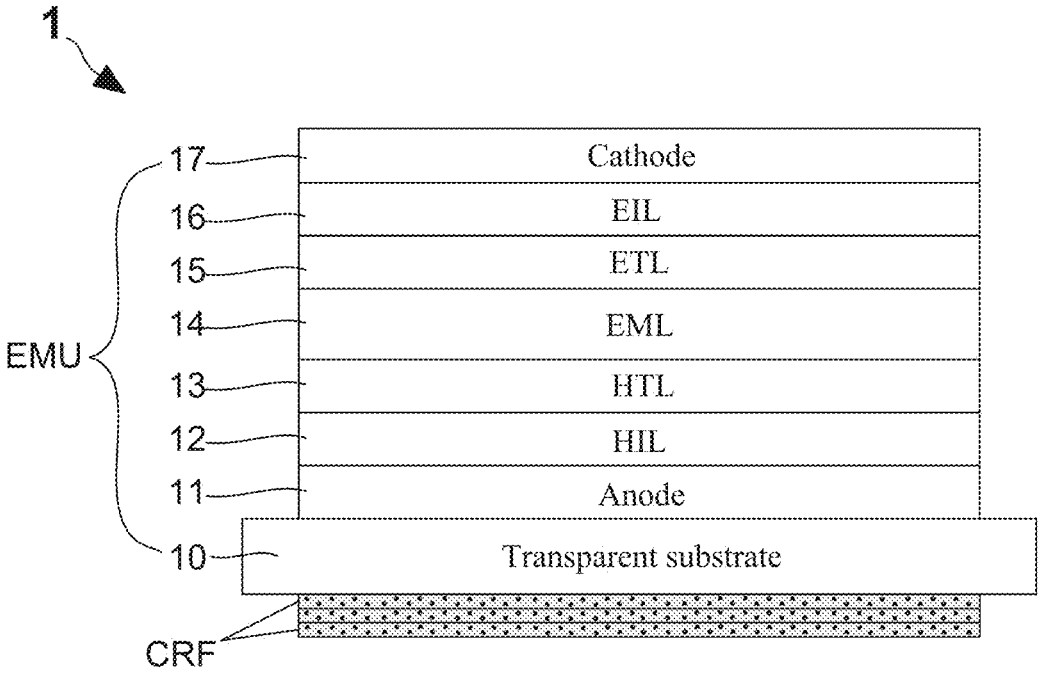
FIG. 4 shows a cross-sectional side view of a first embodiment of the human body-friendly light source.

Referring to FIG. 3 again, and please simultaneously refer to FIG. 4, which illustrates a cross-sectional side view of a first embodiment of the human body-friendly light source. From FIG. 4, it is understood that an OLED component is adopted for being the lighting unit EMU of the human body-friendly light source 1. The lighting unit EMU comprising: a transparent substrate 10, an anode 11 formed on one surface of the transparent substrate 10, a hole injection layer (HIL) 12 formed on the anode 11, a hole transport layer (HTL) 13 formed on the HIL 12, an emission layer (EML) 14 formed on the HTL 13, an electron transport layer (ETL) 15 formed on the EML 14, an electron injection layer (EIL) 16 formed on the ETL 15, and a cathode 17 formed on the EIL 16. On the other hand, FIG. 4 also depicts that a plurality of color temperature reducing films CRF are disposed on an emission surface of the lighting unit EMU (i.e., the other surface of the transparent substrate 10), and the plurality of color temperature reducing films CRF are stacked to each other.

The present invention uses a light conversion film to be the color temperature reducing film CRF, so as to apply a color temperature reducing process to a light outputted from the light emission surface of the lighting unit EMU. After completing a variety of experiments, inventors of the present invention find that the light radiated by the lighting unit EMU has a color temperature and a luminance rolling off with the adding of the number of the temperature reducing films CRF. Experimental data have been collected in following Table (3).

TABLE 3

| Number of temperature reducing film(s) | Color temperature (K) | Sensitivity of melatonin suppression in response to light (%) | Maximum permissible exposure time for retina (s) |
|---|---|---|---|
| 0 | 4,920 | 20.7 | 311 |
| 1 | 3,575 | 15.4 | 427 |
| 2 | 2,788 | 11.2 | 602 |
| 3 | 2,403 | 8.9 | 775 |
| 4 | 2,138 | 7.1 | 990 |
| 5 | 1,852 | 5.2 | 1411 |

From the experimental data of Table (3), it is found that, with the adding of the number of the color temperature films CRF, the light is eventually converted to an orange-red light or an orange-white light with the color temperature in a range between 1,000K and 2,500K. Moreover, the light (i.e., the orange-red light or the orange-white light) has a CIE coordinate positioning near a Planckian locus (also called blackbody radiation curve) in a CIE chromaticity diagram. On the other hand, with the adding of the number of the color temperature films CRF, a sensitivity of melatonin suppression in response to the light is getting lower and a maximum permissible exposure time for retina is getting longer. Because each of the commercial lighting components or devices commonly emits a specific light having color temperature of 3,000-5,600K, the specific light can be converted to a human body-friendly light only if at least two color temperature reducing films CRF stacked to each other are connected to the emission surface of the commercial lighting components or devices. However, it needs to particularly emphasize that, the present invention does not limit the stacking number of the color temperature reducing films CRF even if the experimental data have showed that at least two color temperature reducing films CRF stacked to each other can convert a specific light radiated from a specific lighting device to a human body-friendly light. For instance, it is able to design and manufacture a high-efficiency light conversion film to replace the two stacked color temperature reducing films CRF.

Figure 5:
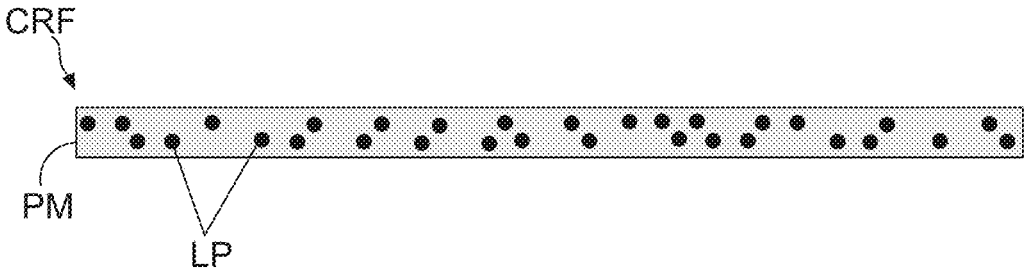
FIG. 5 shows a cross-sectional side view of a color temperature reducing film.

Continuously referring to FIG. 4, and please simultaneously refer to FIG. 5, which illustrates a cross-sectional side view of the color temperature reducing film. According to the design of the present invention, the color temperature reducing film CRF is a light conversion film comprising a polymer substrate PM and a plurality of light conversion particles LP, wherein the light conversion particles LP are doped in or enclosed by the polymer substrate PM. Moreover, the manufacturing material of the polymer substrate can be polydimethylsiloxane (PDMS), polystyrene (PS), polyethylene terephthalate (PET), polycarbonate (PC), cycloolefin co-polymer (COC), cyclic block copolymer (CBC), polylactide (PLA), polyimide (PI), or combination of the above-mentioned two or above materials.

On the other hand, the light conversion particles LP can be quantum dots, wherein the quantum dot is selected from the group consisting of Group II-VI compounds, Group III-V compounds, Group II-VI compounds having core-shell structure, Group III-V compounds having core-shell structure, Group II-VI compounds having non-spherical alloy structure, and combination of the aforesaid two or above compounds. Exemplary materials of the quantum dots for being used as the light conversion particles LP are integrated and listed in following Table (4). Moreover, relations between the fluorescence color of the excitation light and the QDs sizes are also summarized in following Table (5).

TABLE 4

| Types of quantum dot (QD) | Corresponding exemplary material |
|---|---|
| Group II-VI compounds | CdSe or CdS |
| Group III-V compounds | (Al, In, Ga)P, (Al, In, Ga)As, or (Al, In. Ga)N |
| Group III-V compounds having core-shell structure | CdSe/ZnS core-shell QD |
| Group III-V compounds having core-shell structure | InP/ZnS core-shell QD |
| Group II-VI compounds having non-spherical alloy structure | ZnCdSeS |

TABLE 5

| Fluorescence color of the excitation light | Size of QDs |
|---|---|
| Blue-green | 2-7 nm |
| Green | 3-10 nm |
| Yellow | 4-12 nm |
| Orange | 4-14 nm |
| Red | 5-20 nm |

In addition, the light conversion particles LP can also be particles of a phosphor, and the phosphor can an aluminate phosphor, a silicate phosphor, a phosphate phosphor, a sulfide phosphor, or a nitride phosphor. Exemplary materials of the phosphor for being used as the light conversion particles LP are integrated and listed in following Table (6).

TABLE 6

| Types of fluorescent powder | Corresponding exemplary material |
|---|---|
| Aluminate phosphor | Eu doped Y—Al—O multi-composition phosphor |
| Silicate phosphor | $Ca_3Si_2O_7:Eu^{2+}$ |
| Phosphate phosphor | $KSr_{1-x}PO_4:Tb_x$<br>$K_2SiF_6:Mn^{4+}$ (KSF) |
| Sulfide phosphor | ZnS:X<br>X = Au, Ag, Cu, Mn, Cd |
| Nitride phosphor | $\beta$-SiAlON:$Eu^{2+}$ |
| Other-type phosphor | $SrGa_2S_4:Eu^{2+}$ (SGS) |

Please refer to FIG. 4 and FIG. 5 again. It is worth noting that, an oxygen and moisture barrier can be further disposed on the light conversion film CRF consisting of polymer substrate PM and quantum dots (i.e., light conversion particles LP), wherein the oxygen and moisture barrier is made of a specific material selected from the group consisting of polyethylene terephthalate (PET), polyethylene naphthalate (PEN), poly(methyl methacrylate) (PMMA), silica, titanium oxide, aluminum oxide, and combination of the aforesaid two or above materials.

Figure 1:
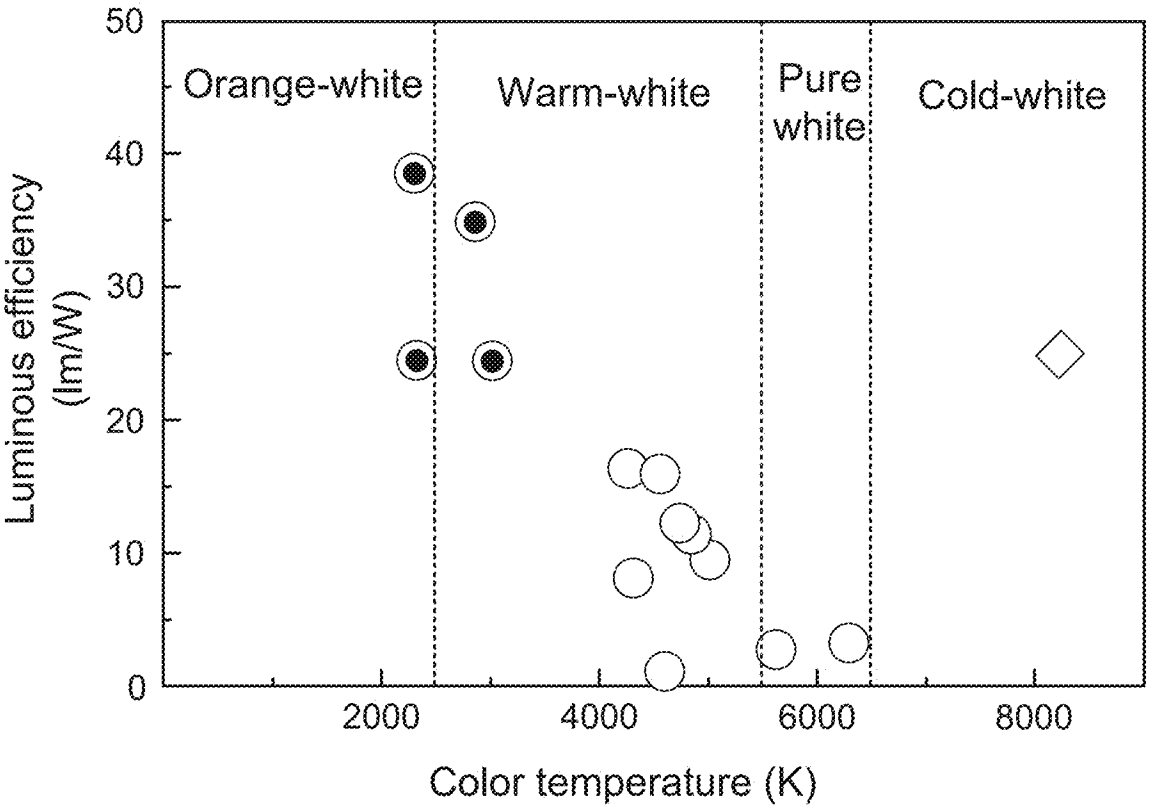
FIG. 1 (Prior art)
FIG. 1 shows a data plot of color temperature versus luminous efficiency.
Figure 2:
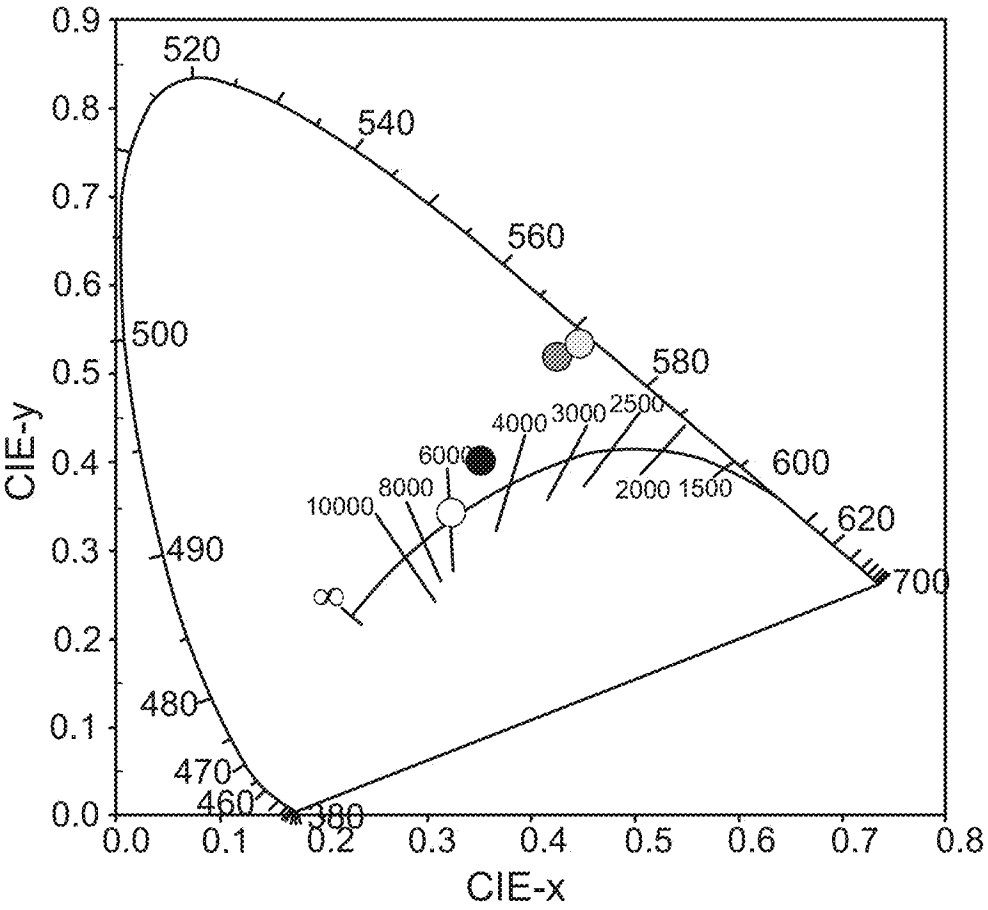
FIG. 2 (Prior art)
FIG. 2 shows a CIE chromaticity diagram.
Figure 6:
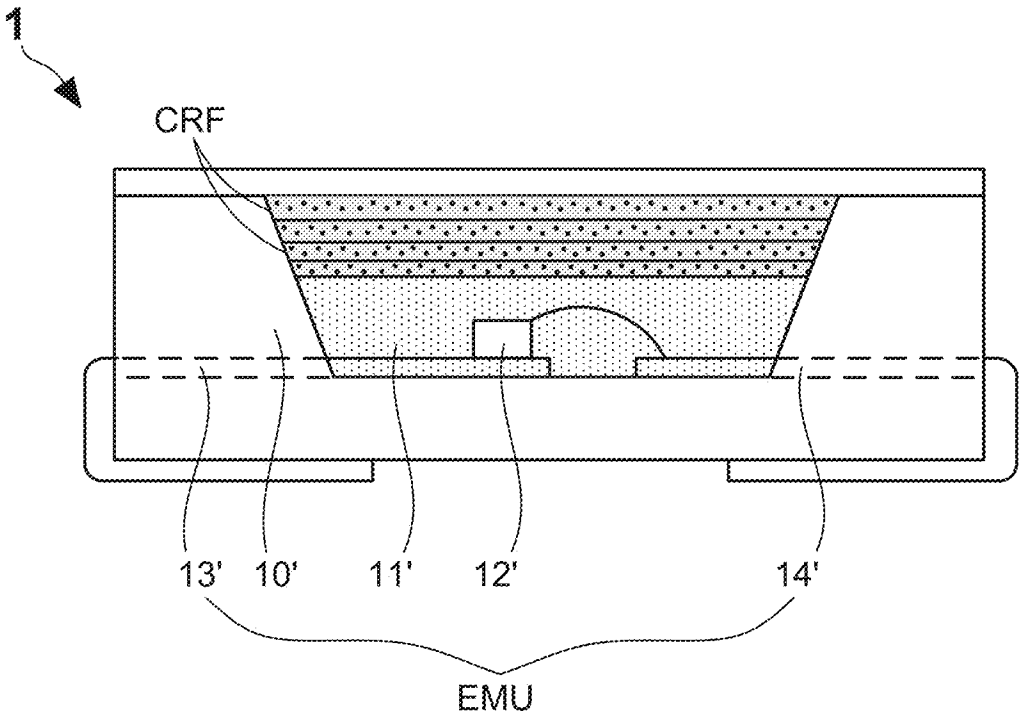
FIG. 6 shows a cross-sectional side view of a second embodiment of the human body-friendly light source.

During the manufacture or production of the human body-friendly light source 1, it does not particularly limit that color temperature reducing film CRF is constituted by a polymer substrate PM and a plurality of light conversion particles LP doped in the polymer substrate PM. The color temperature reducing film CRF can also comprises one polymer substrate PM and at least one light conversion coating layer formed on the polymer substrate PM. Continuously referring to FIG. 2, and please simultaneously refer to FIG. 6, there is provided a cross-sectional side view of a second embodiment of the human body-friendly light source. From FIG. 6, it is understood that an LED component is adopted for being the lighting unit EMU of the human body-friendly light source 1. The lighting unit EMU comprising: an insulation body 10', an LED die 12', and encapsulation member 11', wherein the insulation body 10' has an accommodating recess for receiving the LED die 12'. Moreover, both a first electrical member 13' and a second electrical member 14' have a welding portion and electrical connection portion. The two welding portions locate in the accommodating recess, but the electrical connection portions extend out of the insulation body 10'. Because there are particles of a phosphor doped in the encapsulation member 11', a short-wavelength light emitted by the LED die 12' would be converted to a white light, and then the white light would be converted to an orange-white light or an orange-red light having color temperature of 1,000-2,500K by the color temperature films CRF.

Applications of the Human Body-Friendly Light Source

Figure 7:
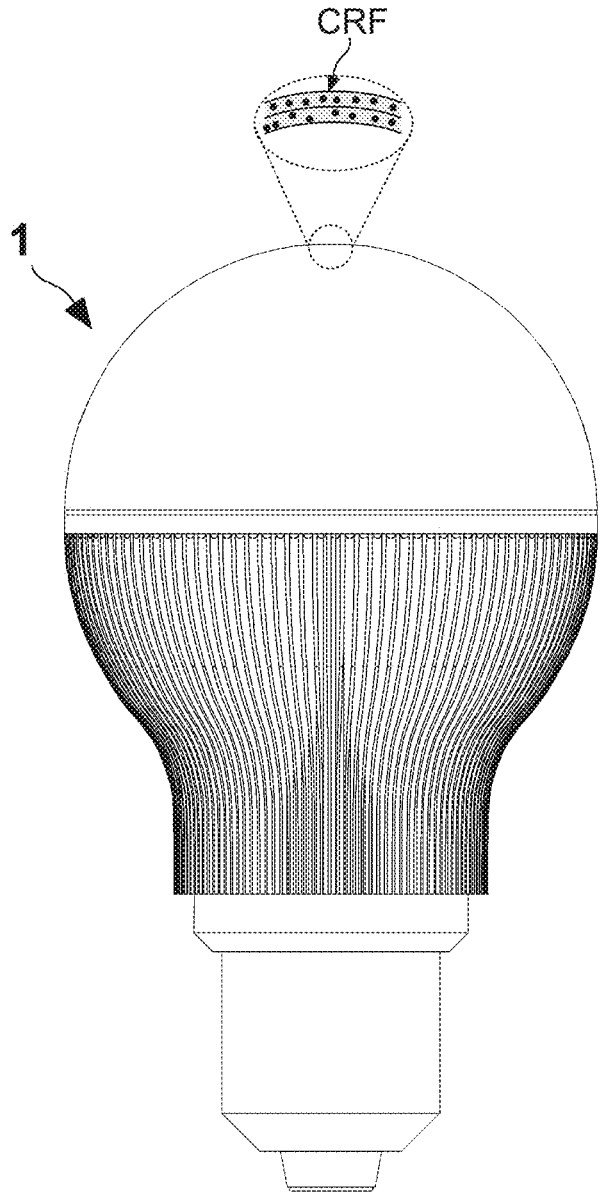
FIG. 7 shows a stereo diagram for describing a first practicable application of the human body-friendly light source.
Figure 8:
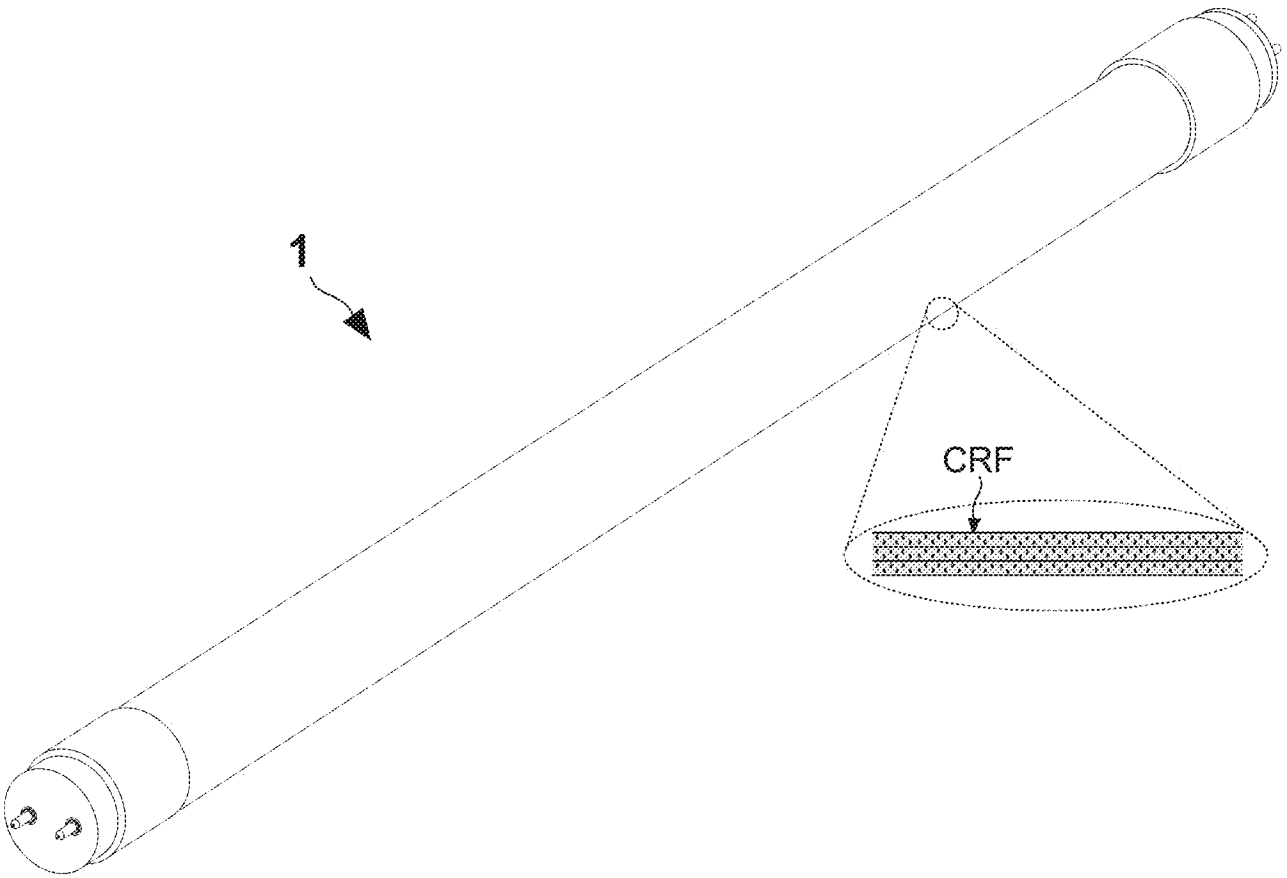
FIG. 8 shows a stereo diagram for describing a second practicable application of the human body-friendly light source.
Figure 9:
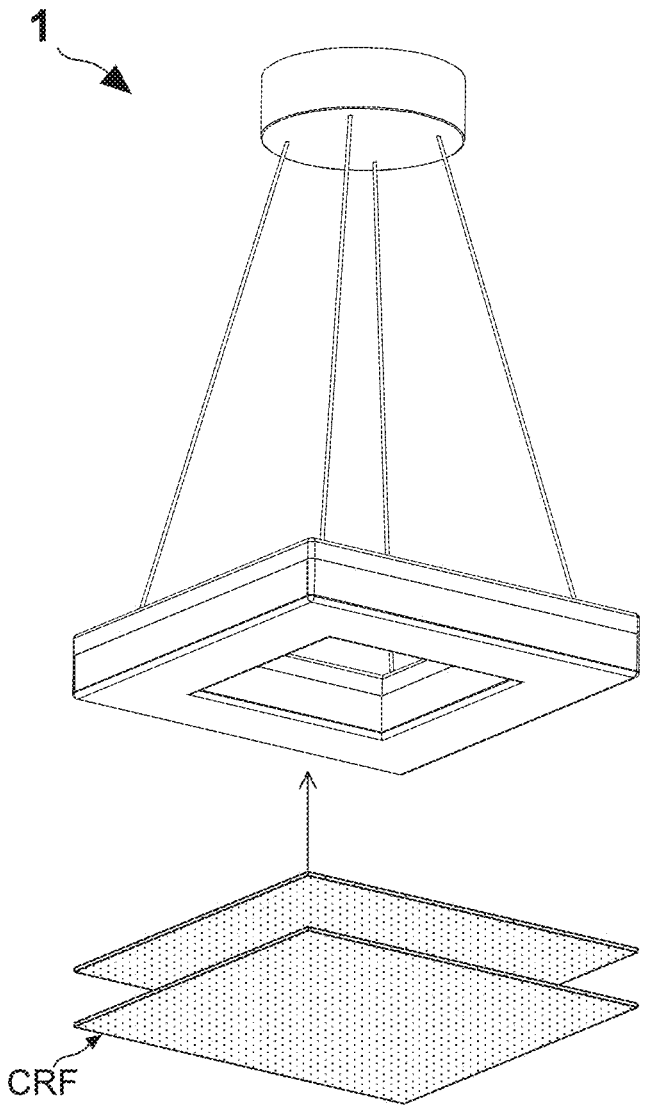
FIG. 9 shows a stereo diagram for describing a third practicable application of the human body-friendly light source.
Figure 10:
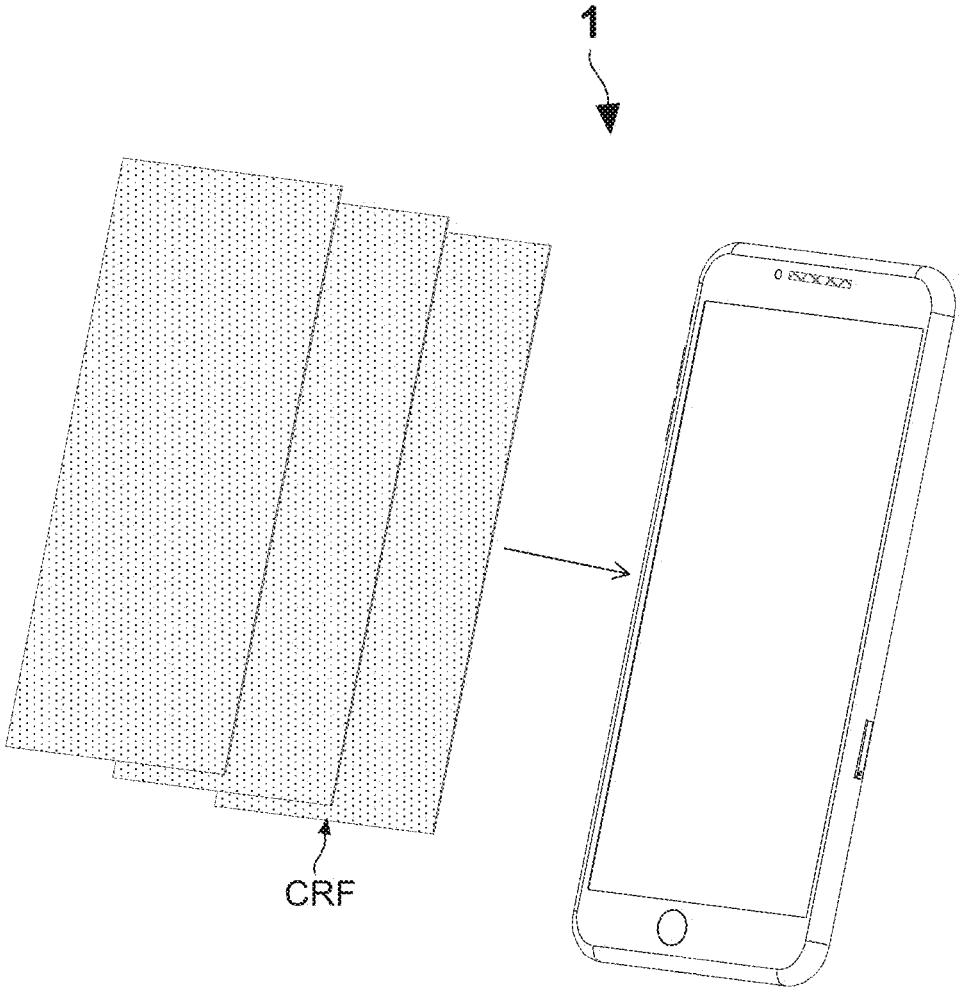
FIG. 10 shows a stereo diagram for describing a fourth practicable application of the human body-friendly light source.
Figure 11:
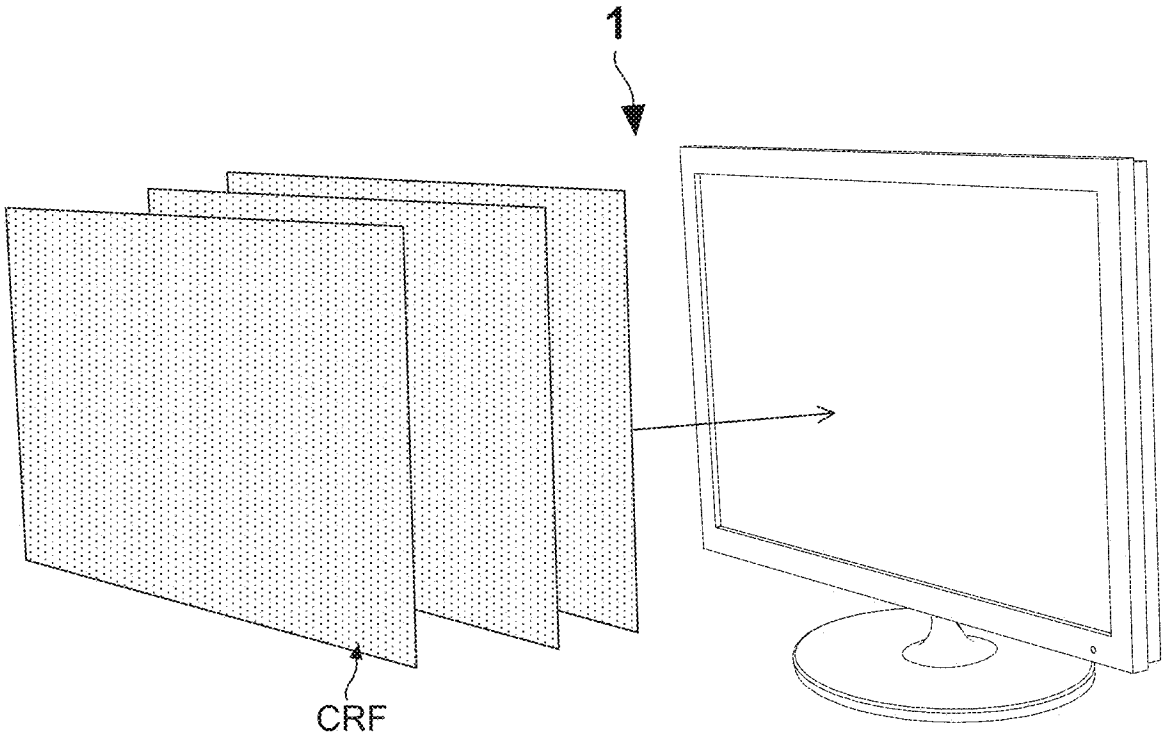
FIG. 11 shows a stereo diagram for describing a fifth practicable application of the human body-friendly light source.

FIG. 7 shows a stereo diagram for describing a first practicable application of the human body-friendly light source, FIG. 8 illustrates a stereo diagram for describing a second practicable application of the human body-friendly light source, and FIG. 9 provides shows a stereo diagram for describing a third practicable application of the human body-friendly light source. From FIG. 7, FIG. 8 and FIG. 9, engineers skilled in development and manufacture of lighting apparatuses are able to know that, this human body-friendly light source 1 can be processed to a light bulb, a light tube, or a planar lighting product. Briefly speaking, the human body-friendly light source 1 of the present invention can be present or provided by a specific form of commercial lighting product. Moreover, as FIG. 7, FIG. 8 and FIG. 9 show, the color temperature films CRF are connected to the emission surface of the lighting unit EMU, such as the inner wall or the outer wall of the housing, the cover or the diffuser of the commercial lighting products. On the other hand, FIG. 10 shows a stereo diagram for describing a fourth practicable application of the human body-friendly light source, and FIG. 11 illustrates a stereo diagram for describing a fifth practicable application of the human body-friendly light source. FIG. 10 and FIG. 11 indicate that the technology of the human body-friendly light source 1 can also be implemented into an electronic device having display screen or a display device.

Experiment I

Figure 12:
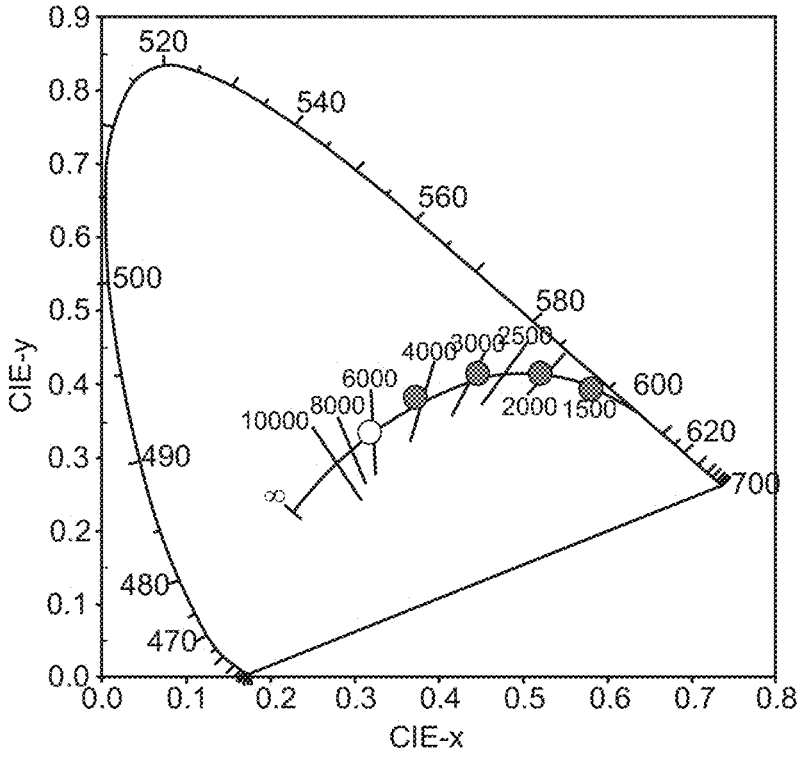
FIG. 12 shows a first CIE chromaticity diagram with measurement data obtained from an LED component.

An LED component capable of emitting a pure-white light with color temperature of 6,000K is used as the lighting unit EMU in experiment I. Moreover, experiment I have four samples of the human body-friendly light source 1, wherein sample 1 comprises the LED component and one color temperature reducing films CRF, sample 2 comprises the LED component and two color temperature reducing films CRF, sample 3 comprises the LED component and three color temperature reducing films CRF, and sample 4 comprises the LED component and four color temperature reducing films CRF. It needs further explain that, the color temperature reducing film CRF comprises a polymer substrate PM and a plurality of light conversion particles LP, wherein the light conversion particles LP are spread in the polymer substrate PM and having a particle size in a range from 5 nm to 20 nm. FIG. 12 shows a first CIE chromaticity diagram with measurement data obtained from an LED component. From the experimental data of FIG. 12, it is found that, the light emitted by the sample 1 has a CIE coordinate positioning near the Planckian locus, and is classified to warm-white light because of having color temperature of 4,150K. Moreover, the light emitted by the sample 2 has a CIE coordinate positioning near the Planckian locus and is classified to warm-white light because of having color temperature of 3,000K. Otherwise, the light emitted by the sample 3 also has a CIE coordinate positioning near the Planckian locus and is classified to orange light because of having color temperature of 1,500-2,000K.

Figure 13:
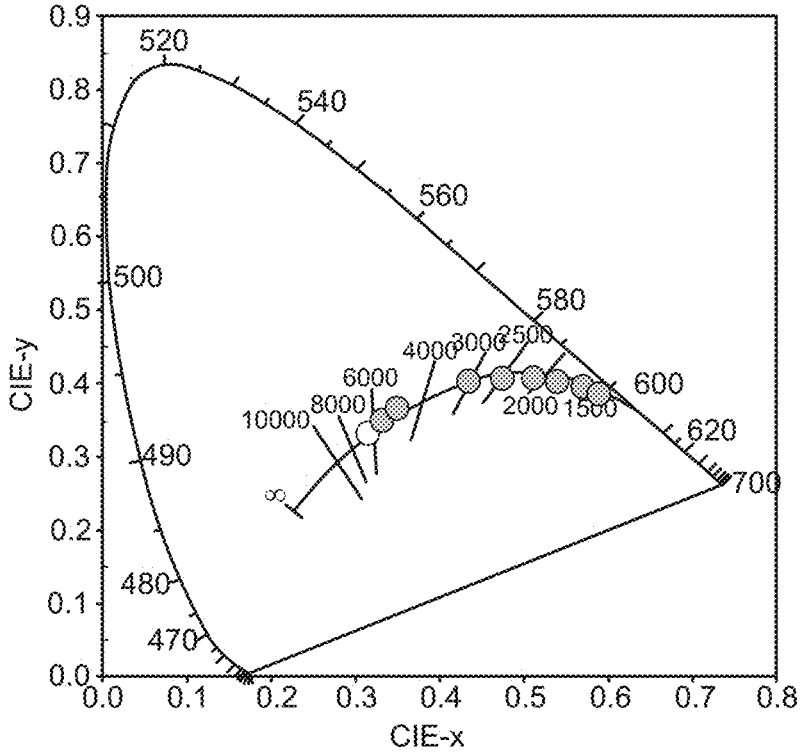
FIG. 13 shows a second CIE chromaticity diagram with measurement data obtained from the same LED component.

In addition, experiment I further comprises eight samples of the human body-friendly light source 1. Samples 5-12 comprise the same LED component and color temperature reducing films CRF with the number of 1, 2, 3, 4, 5, 6, 7, and 8, respectively. Moreover, the light conversion particles LP are spread in the polymer substrate PM and having a particle size in a range from 3 nm to 10 nm. FIG. 13 shows a second CIE chromaticity diagram with measurement data obtained from the same LED component. From the experimental data of FIG. 13, it is observed that, with the adding of the number of the color temperature reducing films CRF, the light emitted by the LED component is eventually converted to an orange light, an orange-red light or an orange-white light having the color temperature in a range between 1,000K and 2,500K. Moreover, the light has a CIE coordinate positioning near the Planckian locus.

Figure 14:
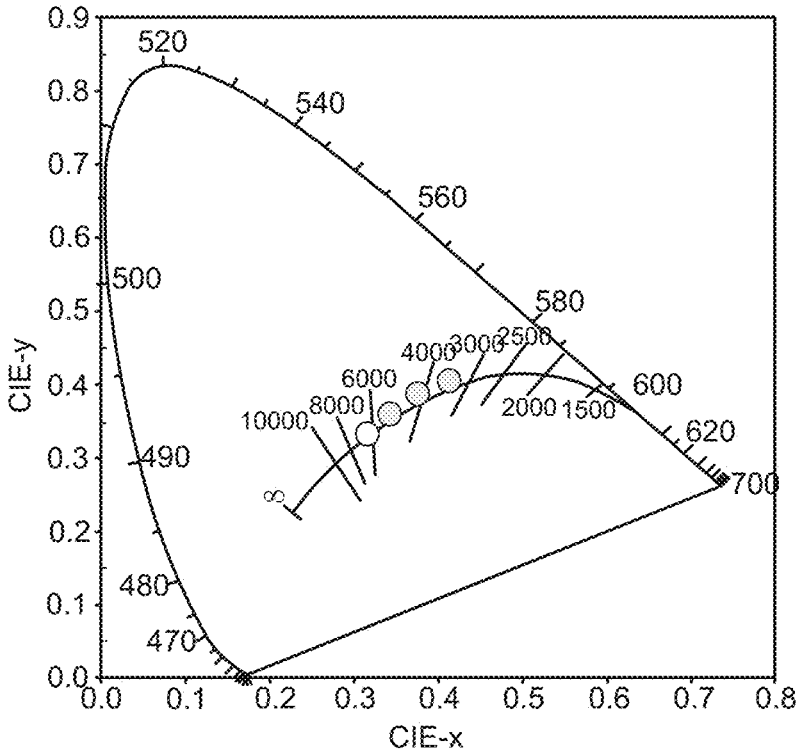
FIG. 14 shows a third CIE chromaticity diagram with measurement data obtained from the same LED component.

Experiment I further comprises other three samples of the human body-friendly light source 1. Samples 13-15 comprise the same LED component and color temperature reducing films CRF with the number of 1, 2 and 3, respectively. Moreover, the light conversion particles LP are spread in the polymer substrate PM and having a particle size in a range from 2 nm to 7 nm. FIG. 14 shows a third CIE chromaticity diagram with measurement data obtained from the same LED component. From the experimental data of FIG. 14, it is observed that, the color temperature of the light emitted by the LED component rolls off with the adding of the number of the color temperature reducing films CRF, and the light has a CIE coordinate positioning near the Planckian locus.

Therefore, experimental data of FIG. 12, FIG. 13 and FIG. 14 have proved that, after connecting a plurality of color temperature reducing films CRF to an emission surface of one lighting unit EMU, the color temperature reducing films CRF are able to apply a color temperature reducing process to a light outputted from the light emission surface. As a result, the light has a color temperature rolling off with the adding of the number of the at least one color temperature reducing film, and also has a CIE coordinate positioning near a Planckian locus in a CIE chromaticity diagram. Moreover, with the adding of the number of the at least one color temperature reducing film, the light is eventually converted to a human body-friendly light, i.e., an orange light, an orange-red light or an orange-white light having color temperature in a range between 1,000K and 2,500K.

Experiment II

Figure 15:
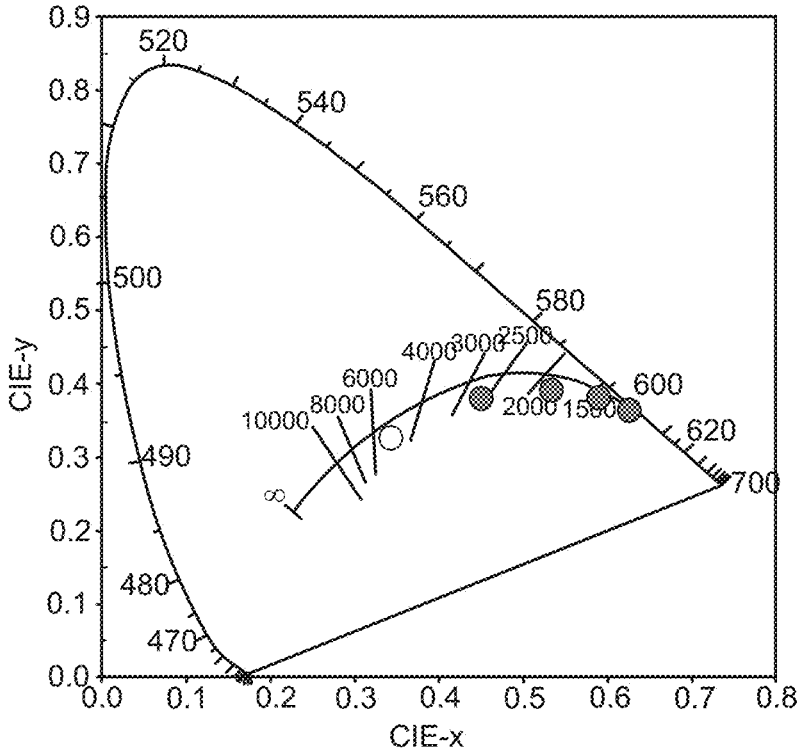
FIG. 15 shows a fourth CIE chromaticity diagram with measurement data obtained from an OLED component.

In experiment II, an OLED component capable of emitting a war-white light with color temperature of 5,400K is used as the lighting unit EMU. Moreover, experiment II have four samples of the human body-friendly light source 1, wherein sample 1 comprises the OLED component and one color temperature reducing films CRF, sample 2 comprises the OLED component and two color temperature reducing films CRF, sample 3 comprises the OLED component and three color temperature reducing films CRF, and sample 4 comprises the OLED component and four color temperature reducing films CRF. It needs further explain that, the color temperature reducing film CRF comprises a polymer substrate PM and a plurality of light conversion particles LP, wherein the light conversion particles LP are spread in the polymer substrate PM and having a particle size in a range from 5 nm to 20 nm. FIG. 15 shows a fourth CIE chromaticity diagram with measurement data obtained from an OLED component. From the experimental data of FIG. 15, it is found that, the light emitted by the sample 1 has color temperature about 2,500K and also has CIE coordinate positioning near the Planckian locus. Moreover, the light emitted by the sample 2 has a CIE coordinate positioning near the Planckian locus and is classified to orange light because of having color temperature lower than 2,000K. Otherwise, the light emitted by the sample 3 also has a CIE coordinate positioning near the Planckian locus and is classified to orange light because of having color temperature lower than 1,500K.

Figure 16:
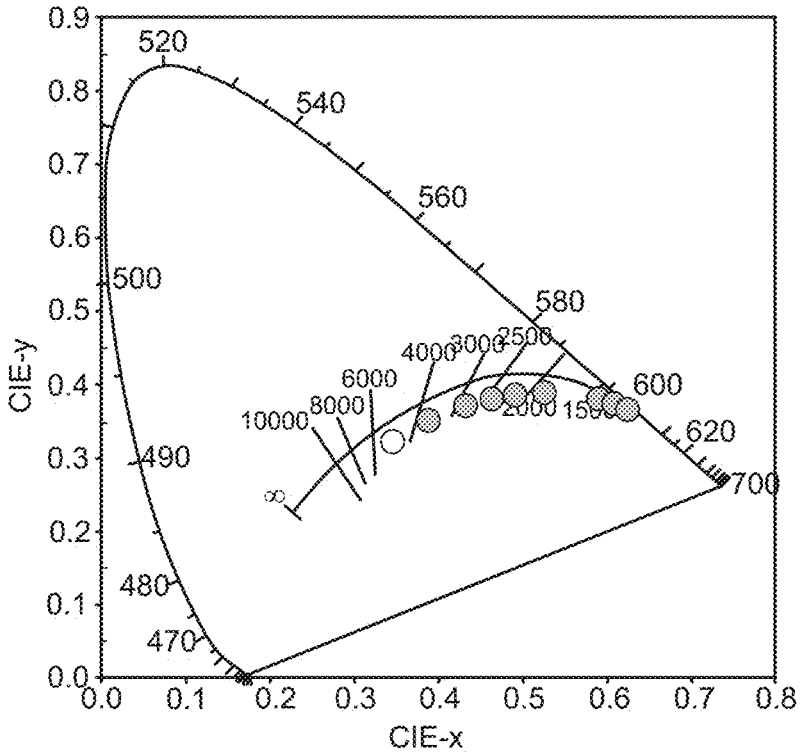
FIG. 16 shows a fifth CIE chromaticity diagram with measurement data obtained from the same OLED component.

In addition, experiment II further comprises eight samples of the human body-friendly light source 1. Samples 5-12 comprise the sameO LED component and color temperature reducing films CRF with the number of 1, 2, 3, 4, 5, 6, 7, and 8, respectively. Moreover, the light conversion particles LP are spread in the polymer substrate PM and having a particle size in a range from 3 nm to 10 nm. FIG. 16 shows a fifth CIE chromaticity diagram with measurement data obtained from the same OLED component. From the experimental data of FIG. 16, it is observed that, with the adding of the number of the color temperature reducing films CRF, the light emitted by the OLED component is eventually converted to an orange light, an orange-red light or an orange-white light. Moreover, the light has a CIE coordinate positioning near the Planckian locus.

Figure 17:
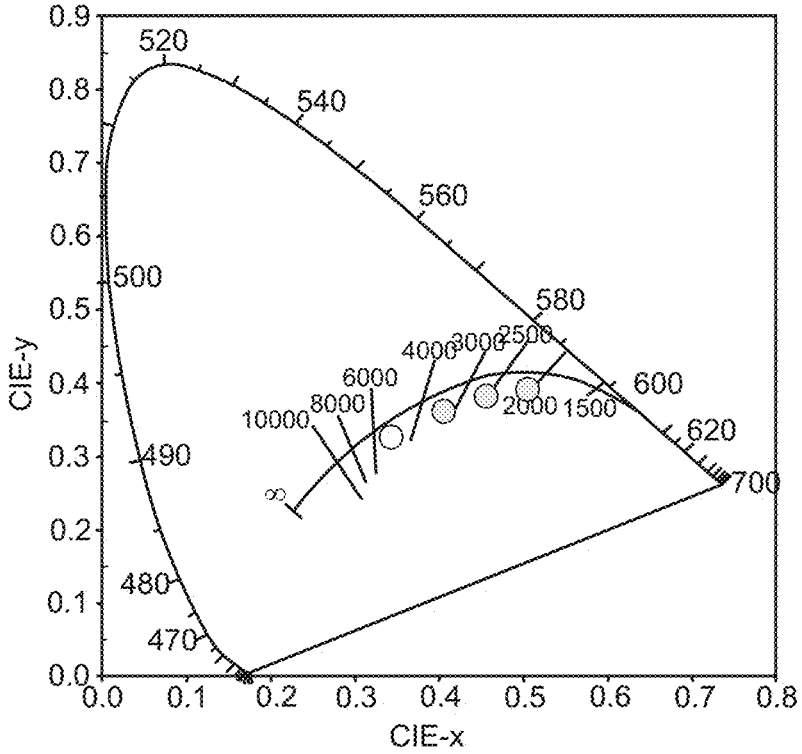
FIG. 17 shows a sixth CIE chromaticity diagram with measurement data obtained from the same OLED component.

Experiment II further comprises other three samples of the human body-friendly light source 1. Samples 13-15 comprise the same OLED component and color temperature reducing films CRF with the number of 1, 2 and 3, respectively. Moreover, the light conversion particles LP are spread in the polymer substrate PM and having a particle size in a range from 2 nm to 7 nm. FIG. 17 shows a sixth CIE chromaticity diagram with measurement data obtained from the same OLED component. From the experimental data of FIG. 17, it is observed that, the color temperature of the light emitted by the OLED component rolls off with the adding of the number of the color temperature reducing films CRF, and the light has a CIE coordinate positioning near the Planckian locus.

Therefore, experimental data of FIG. 15, FIG. 16 and FIG. 17 have proved that, after connecting a plurality of color temperature reducing films CRF to an emission surface of one lighting unit EMU, the color temperature reducing films CRF are able to apply a color temperature reducing process to a light outputted from the light emission surface. As a result, the light has a color temperature rolling off with the adding of the number of the at least one color temperature reducing film, and also has a CIE coordinate positioning near a Planckian locus in a CIE chromaticity diagram. Moreover, with the adding of the number of the at least one color temperature reducing film, the light is eventually converted to a human body-friendly light, i.e., an orange light, an orange-red light or an orange-white light having color temperature in a range between 1,000K and 2,500K.

Moreover, from the data obtained through the experiment I, it is found that the light of the LED component has an original CIE coordinate positioning above the Planckian locus. However, in spite of the fact that the light is treated with the color temperature reducing process by one or more color temperature reducing films CRF, the light still has a CIE coordinate positioning above and near the Planckian locus. On the other hand, from the data obtained through the experiment II, it can also observed that the light of the OLED component has an original CIE coordinate positioning under the Planckian locus. However, in spite of the fact that the light is treated with the color temperature reducing process by one or more color temperature reducing films CRF, the light still has a CIE coordinate positioning under and near the Planckian locus. Therefore, experimental data have proved that, after applying a color temperature reducing process to a specific light radiated by a specific lighting device, the light is converted to a human body-friendly light because of having a CIE coordinate positioning near the Planckian locus in a CIE chromaticity diagram.

Therefore, through above descriptions, the human body-friendly light source 1 proposed by the present invention has been introduced completely and clearly; in summary, the present invention includes the advantages of:

(1) The present invention provides a human body-friendly light source 1, mainly comprising: at least one lighting unit EMU and a plurality of color temperature reducing films CRF stacked to each other. The color temperature reducing films CRF are connected to a light emission surface of the lighting unit EMU, so as to apply a color temperature reducing treatment to a light emitted by the lighting unit EMU and then convert the light to a human body-friendly light.

(2) Moreover, exponential data have proved that, two stacked CT reducing films exhibit an apparent color temperature reducing effect on the lighting unit. Exponential data also proved that, with the increasing of the stack numbers of the CT reducing films, the light is eventually concerted to a human body-friendly light (i.e., an orange-white light or an orange-red light), so as to make a sensitivity of melatonin suppression in response to the light being getting lower and a maximum permissible exposure time for retina be getting longer.

The above description is made on embodiments of the present invention. However, the embodiments are not intended to limit scope of the present invention, and all equivalent implementations or alterations within the spirit of the present invention still fall within the scope of the present invention.

What is claimed is:

1. A human body-friendly light source, comprising:

at least one lighting unit;

at least three color temperature reducing films, being stacked to each other and connected to a light emission surface of the lighting unit, so as to apply a color temperature reducing treatment to a light outputted from the light emission surface;

wherein the light that passes through the at least three color temperature reducing films is subject to a color temperature rolling off such that the light has a CIE coordinate positioned near a Planckian locus in a CIE chromaticity diagram;

wherein the light that passes through the at least three color temperature reducing films is eventually converted to an orange-red light or an orange-white light, such that the light has a color temperature in a range between 1,000K and 2,500K for making a maximum permissible exposure (MPE) be getting longer.

2. The human body-friendly light source of claim 1, wherein the lighting unit is selected from the group consisting of LED component, QD-LED component, OLED component, fluorescent lighting device, LED lighting device, QD-LED lighting device, OLED lighting device, lighting tube, planar lighting device, and light bulb.

3. The human body-friendly light source of claim 1, wherein the color temperature reducing film is a light conversion film comprising a polymer substrate and at least one light conversion coating layer formed on the polymer substrate.

4. The human body-friendly light source of claim 1, wherein the color temperature reducing film is a light conversion film comprising a polymer substrate and a plurality of light conversion particles, wherein the light conversion particles are doped in or enclosed by the polymer substrate.

5. The human body-friendly light source of claim 4, wherein the manufacturing material of the polymer substrate is selected from the group consisting of polydimethylsiloxane (PDMS), polystyrene (PS), polyethylene terephthalate (PET), polycarbonate (PC), cycloolefin co-polymer (COC), cyclic block copolymer (CBC), polylactide (PLA), polyimide (PI), and combination of the above-mentioned two or above materials.

6. The human body-friendly light source of claim 4, wherein the light conversion particles are quantum dots, and the quantum dot is selected from the group consisting of Group II-VI compounds, Group III-V compounds, Group II-VI compounds having core-shell structure, Group III-V compounds having core-shell structure, Group II-VI compounds having non-spherical alloy structure, and combination of the aforesaid two or above compounds.

7. The human body-friendly light source of claim 4, wherein the light conversion particles are particles of a phosphor, and the phosphor is selected from the group consisting of aluminate phosphor, silicate phosphor, phosphate phosphor, sulfide phosphor, and nitride phosphor.

8. The human body-friendly light source of claim 4, wherein an oxygen and moisture barrier is further disposed on the light conversion film, and the oxygen and moisture barrier is made of a specific material selected from the group consisting of polyethylene terephthalate (PET), polyethylene naphthalate (PEN), poly(methyl methacrylate) (PMMA), silica, titanium oxide, aluminum oxide, and combination of the aforesaid two or above materials.

* * * * *